US008047822B2

(12) United States Patent
Shulver et al.

(10) Patent No.: US 8,047,822 B2
(45) Date of Patent: Nov. 1, 2011

(54) CONTINUOUSLY VARIABLE DISPLACEMENT VANE PUMP AND SYSTEM

(75) Inventors: David R. Shulver, Richmond Hill (CA); Adrian C. Cioc, Ajax (CA)

(73) Assignee: Magna Powertrain Inc., Concord (CA)

( * ) Notice: Subject to any disclaimer, the term of this patent is extended or adjusted under 35 U.S.C. 154(b) by 463 days.

(21) Appl. No.: 12/299,538

(22) PCT Filed: May 4, 2007

(86) PCT No.: PCT/CA2007/000754

§ 371 (c)(1),
(2), (4) Date: Nov. 12, 2008

(87) PCT Pub. No.: WO2007/128106

PCT Pub. Date: Nov. 15, 2007

(65) Prior Publication Data

US 2009/0202375 A1 Aug. 13, 2009

(51) Int. Cl.
*F04C 2/00* (2006.01)
*F04C 14/18* (2006.01)

(52) U.S. Cl. ..... 418/26; 418/27; 418/30; 417/220

(58) Field of Classification Search ..... 418/26–31, 418/259; 417/220, 310, 213
See application file for complete search history.

(56) References Cited

U.S. PATENT DOCUMENTS

| | | | | |
|---|---|---|---|---|
| 2,628,567 A | | 2/1953 | Lancey | |
| 3,784,326 A | | 1/1974 | Lagana et al. | |
| 4,035,105 A | | 7/1977 | Dantlgraber | |
| 4,342,545 A | * | 8/1982 | Schuster | 418/26 |
| 4,538,974 A | * | 9/1985 | Stich et al. | 418/26 |
| 4,551,080 A | | 11/1985 | Geiger | |
| 4,678,412 A | | 7/1987 | Dantlgraber | |
| 4,950,137 A | * | 8/1990 | Fischer et al. | 418/26 |
| 5,090,881 A | * | 2/1992 | Suzuki et al. | 418/26 |
| 5,141,418 A | | 8/1992 | Ohtaki et al. | |
| 5,518,380 A | * | 5/1996 | Fujii et al. | 418/26 |
| 6,530,752 B2 | | 3/2003 | Oba et al. | |
| 6,619,928 B2 | | 9/2003 | Konishi | |
| 6,623,250 B2 | | 9/2003 | Zagranski et al. | |
| 6,688,862 B2 | | 2/2004 | Jeronymo et al. | |
| 6,722,856 B2 | * | 4/2004 | Schneider | 417/220 |

FOREIGN PATENT DOCUMENTS

| | | | | |
|---|---|---|---|---|
| JP | 55087882 A | * | 7/1980 | 418/26 |
| JP | 56143383 A | * | 11/1981 | |
| JP | 59058186 A | * | 4/1984 | 418/26 |

* cited by examiner

*Primary Examiner* — Theresa Trieu
(74) *Attorney, Agent, or Firm* — Dobrusin & Thennisch PC

(57) ABSTRACT

A vane pump (20) is provided which has an output pressure hat can be selected from a continuous range of pressures, independent of the operating speed of the pump. The pump has first (68) and second (72) control chambers which create opposed forces on the pump control ring (40) to selectively move the pump control ring (40) between maximum displacement and minimum displacement positions. In one embodiment, the control chamber (68) which urges the ump control ring to the minimum displacement position is continually supplied with pressurized working fluid during operation of the ump while the control chamber (72) which urges the pump control ring to the maximum displacement position can selectively be supplied with pressurized working fluid, isolated, or can be relieved of pressurized working fluid to alter the displacement of the pump.

16 Claims, 6 Drawing Sheets

CONTINUOUSLY VARIABLE DISPLACEMENT VANE PUMP AND SYSTEM

FIELD OF THE INVENTION

The present invention relates to variable displacement vane pumps. More specifically, the present invention relates to a variable displacement vane pump and system whose output pressure is continuously variable and which can be selected independent of the operating speed of the pump.

BACKGROUND OF THE INVENTION

Mechanical systems, such as internal combustion engines and automatic transmissions, typically include a lubrication pump to provide lubricating oil, under pressure, to many of the moving components and/or subsystems of the mechanical systems. In most cases, the lubrication pump is driven by a mechanical linkage to the mechanical system and thus the operating speed, and output, of the pump varies with the operating speed of the mechanical system. While the lubrication requirements of the mechanical system also vary with the operating speed of the mechanical system, unfortunately the relationship between the variation in the output of the pump and the variation of the lubrication requirements of the mechanical system is generally nonlinear. The difference in these requirements is further exacerbated when temperature related variations in the viscosity and other characteristics of the lubricating oil and mechanical system are factored in.

To deal with these differences, prior art fixed displacement lubricating pumps were generally designed to operate safely and effectively at high, or maximum, oil temperatures, resulting in an oversupply of lubricating oil at most mechanical system operating conditions and a waste, or pressure relief, valve was provided to "waste" the surplus lubricating oil back into the pump inlet or oil sump to avoid over pressure conditions in the mechanical system. In some operating conditions such as low oil temperatures, the overproduction of pressurized lubricating oil can be 500% of the mechanical system's needs so, while such systems work reasonably well, they do result in a significant energy loss as energy is used to pressurize the unneeded lubricating oil which is then "wasted" through the relief valve.

More recently, variable displacement vane pumps have been employed as lubrication oil pumps. Such pumps generally include a control ring, or other mechanism, which can be operated to alter the volumetric displacement of the pump and thus its output at an operating speed. Typically, a feedback mechanism, in the form of a piston in a control chamber or a control chamber acting directly upon the control ring, is supplied with pressurized lubricating oil from the output of the pump, either directly or via an oil gallery in the mechanical system, alters the displacement of the pump to operate the pump to avoid over pressure situations in the engine throughout the expected range of operating conditions of the mechanical system. An example of such a variable displacement pump is shown in U.S. Pat. No. 4,342,545 to Schuster.

While such variable displacement pumps provide some improvements in energy efficiency over fixed displacement pumps, they still result in a significant energy loss as their displacement is controlled, directly or indirectly, by the output pressure of the pump which changes with the operating speed of the mechanical system, rather than with the changing requirements of the lubrication system. Accordingly, such variable displacement pumps must still be designed to provide oil pressures which meet the highest expected mechanical system requirements, despite operating temperatures and other variables, even when the mechanical system operating conditions normally do not necessitate such high requirements.

SUMMARY OF THE INVENTION

It is an object of the present invention to provide a novel vane pump with continuously variable pressure control which obviates or mitigates at least one disadvantage of the prior art.

According to a first aspect of the present invention, there is provided a vane pump with continuously variable output pressure, comprising: a variable displacement vane pump having a pump control ring which is moveable to alter the displacement of the pump; a first control chamber operable to create a force on the pump control ring to urge the pump control ring towards the position of minimum displacement, the force resulting from pressurized working fluid in the first control chamber; a second control chamber operable to create a force on the pump control ring to urge the pump control ring towards the position of maximum displacement, the force resulting from pressurized working fluid in the second control chamber; a control means operable to vary supply of pressurized working fluid to at least one of the first and second control chambers to vary the displacement of the pump during operation of the pump to achieve an output pressure selected from a continuously variable range of output pressures from the pump which are independent from the operating speed of the pump.

According to another aspect of the present invention, there is provided a vane pump to supply pressurized working fluid to a mechanical system, the output pressure being selected from a continuously variable range of output pressures from the pump which are independent of the operating speed of the pump, comprising: a variable displacement vane pump having a pump control ring which is moveable to alter the displacement of the pump; a first control chamber operable to receive working fluid pressurized by the pump to create a force to urge the pump control ring towards the position of minimum displacement; a biasing spring to urge the pump control ring towards the maximum displacement position; a second control chamber operable to receive working fluid pressurized by the pump to create a force to urge the pump control ring towards the position of maximum displacement; a control means operable to vary the supply of pressurized working fluid to at least one of the first and second control chambers to vary the displacement of the pump during operation of the pump to achieve an output pressure selected from a continuously variable range of output pressures from the pump which are independent from the operating speed of the pump; and a third control chamber operable to continuously receive working fluid pressurized by the operation of the pump to create a force on the pump control ring to oppose the force of the biasing spring, the third control chamber and the biasing spring providing a failsafe function should a failure occur in the control means, the first control chamber or the second control chamber.

The present invention provides a vane pump whose output pressure can be selected from a continuous range of pressures, independent of the operating speed of the pump. The pump includes at least first and second control chambers which create opposed forces on the pump control ring to selectively move the pump control ring between maximum displacement and minimum displacement positions. In one embodiment, the control chamber which urges the pump control ring to the minimum displacement position is continually supplied with pressurized working fluid during operation of the pump while the control chamber which urges the pump control ring to the maximum displacement position can selectively be supplied with pressurized working fluid, isolated or can be relieved of pressurized working fluid to alter the displacement of the pump as desired. In another embodiment, each control chamber can be selectively supplied with pressurized working fluid, isolated or can be relieved of pressurized working fluid to alter the displacement of the pump as desired. In another embodiment, three control chambers are employed, the third control chamber being continuously supplied with working fluid pressurized during operation of the pump, the third control chamber acting against the force of the biasing spring to provide a failsafe function should a failure occur in the first or second control chambers or with the selective supply, isolation or relief of the first or second control chambers. Both pivoting pump control ring and sliding pump control ring embodiments are disclosed.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
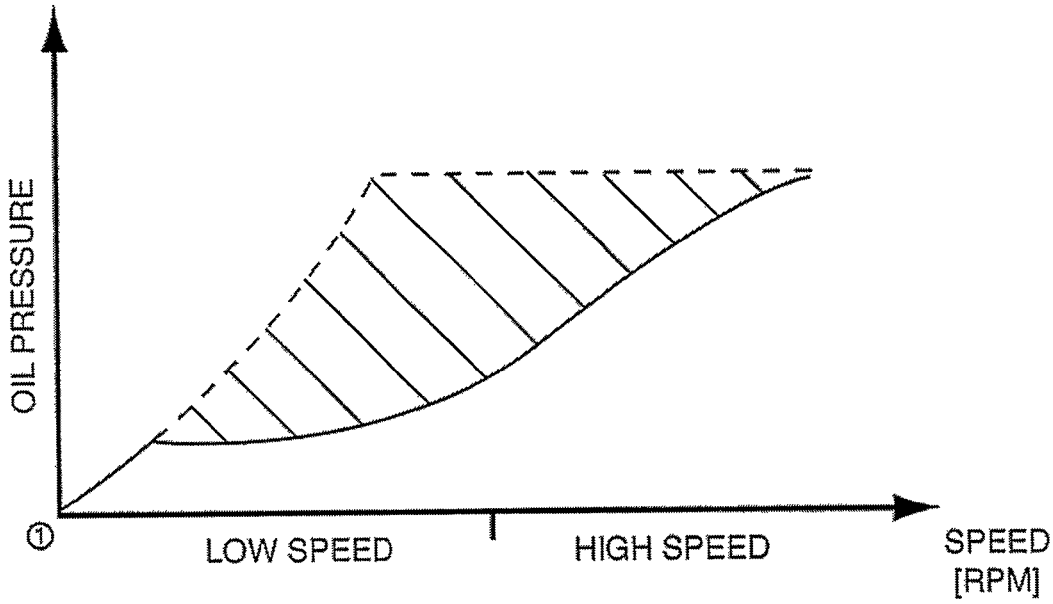
Fig.1 (Prior art)
FIG. 1 shows an example of a plot of the oil pressure demand of a mechanical system versus the output of a prior art lubricating pump.

FIG. 1 shows a typical plot of the lubricating oil pressure requirement (shown in solid line) of a mechanical system, such as a typical internal combustion engine, versus the output (shown in dashed line) of a prior art variable displacement pump, such as the pump taught in the above-mentioned Schuster patent. The corner on the output (dashed line) results from the movement of the control slide by the control piston to reduce the displacement of the pump as the output of the pump reaches a preset value. The shaded area between the engine demand curve and the pump output curve represents the engine operating conditions wherein energy is lost as the pump pressure output exceeds engine demand.

Figure 2:
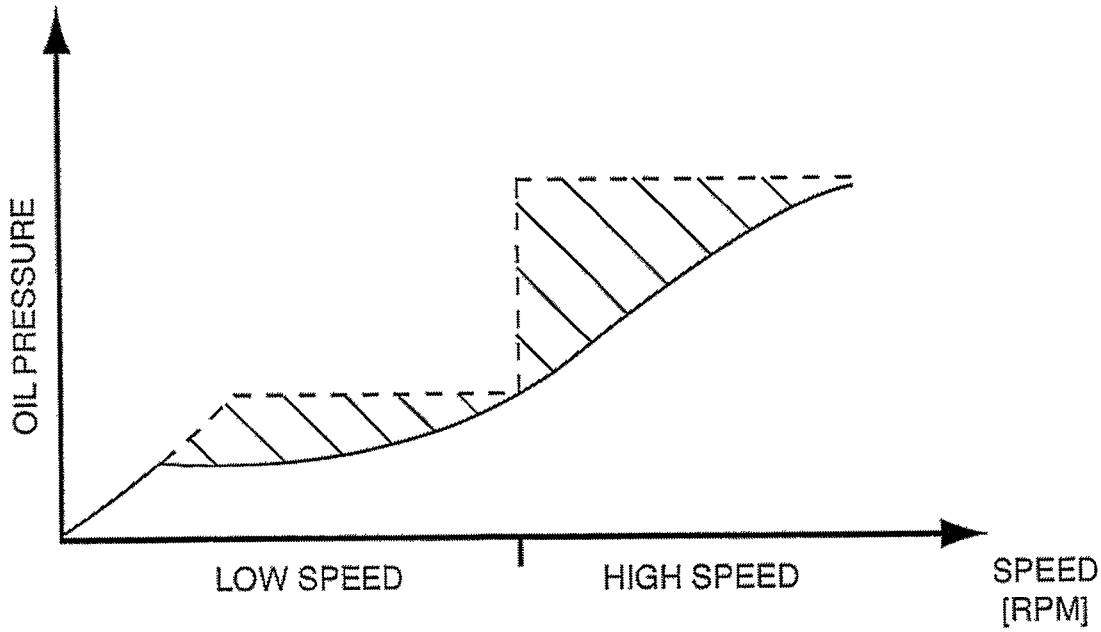
FIG. 2 shows a plot of the oil pressure demand of a mechanical system versus the output of a variable displacement vane pump system with two equilibrium pressure operating points.

More recently, a variable displacement vane pump has been developed, as described in co-pending U.S. Provisional Patent Application 60/763,720, entitled, "Variable Displacement Variable Pressure Vane Pump System", filed Jan. 31, 2006 and assigned to the assignee of the present invention, in which a two step adjustment of the output pressure of the pump can be obtained to reduce the energy loss in the pump by more closely matching the output pressure of the pump to the requirements of the mechanical system. FIG. 2 shows a plot, similar to that of FIG. 1, illustrating an improvement obtained with that Variable Displacement Variable Pressure Vane Pump System invention.

However, as is still apparent from FIG. 2, energy is still wasted pumping working fluid that is not required by the mechanical system, as represented by the shaded area of the plot.

Figure 3:
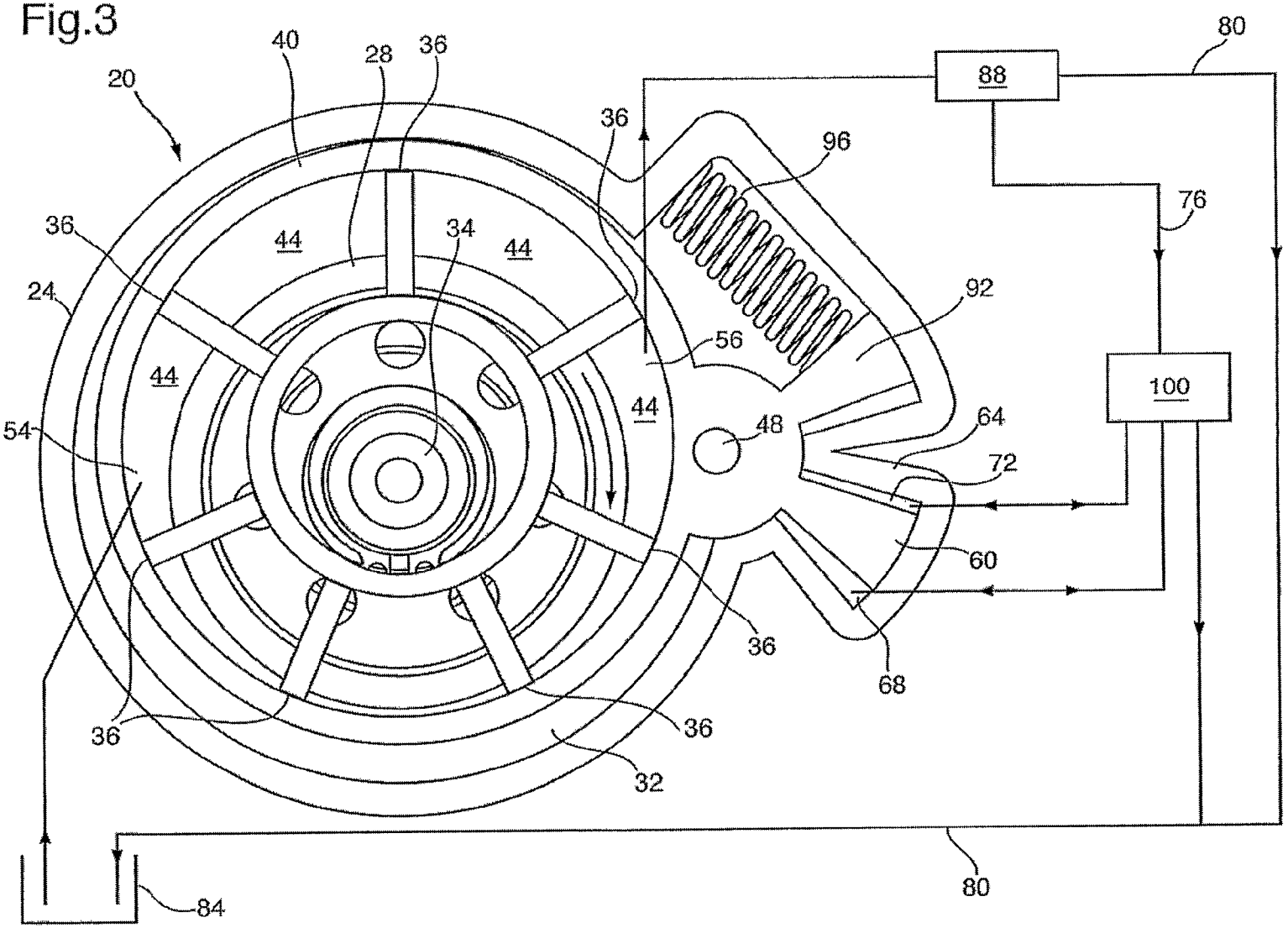
FIG. 3 shows a vane pump whose output pressure is selectable from a continuous range of pressures in accordance with the present invention.

FIG. 3 shows a pump system and vane pump 20 in accordance with the present invention and pump 20 has a continuously variable pressure control system.

Specifically, pump 20 includes a pump housing 24 and a pump rotor 28 rotatably mounted within a rotor chamber 32 in housing 24. Rotor 28 is turned, clockwise in the illustrated embodiment, with a drive shaft 34 and a series of slidable pump vanes 36 rotate with rotor 28, the radially outer end of each vane 36 engaging the inner surface of a pump control ring 40 to divide the volume about rotor 28 into a series of pumping chambers 44, defined by the inner surface of pump control ring 40, pump rotor 28 and vanes 36.

In the illustrated embodiment, pump control ring 40 is mounted within housing 24 via a pivot pin 48. It is also contemplated that pump control ring 40 can be pivotally mounted within housing 24 via a pivot surface (not shown) or via any other suitable means as will occur to those of skill in the art.

The pivoting of pump control ring 40 allows the center of pump control ring 40 to be moved relative to the center of rotor 28. As the center of pump control ring 40 is located eccentrically with respect to the center of pump rotor 28, and each of the interior of pump control ring 40 and pump rotor 28 are circular in shape, the volume of pumping chambers 44 changes as pumping chambers 44 rotate around rotor chamber 32, with their volume becoming larger at the low pressure side (the left hand side of rotor chamber 32 in FIG. 3) of pump 20 and smaller at the high pressure side (the right hand side of rotor chamber 32 in FIG. 3) of pump 20.

This change in volume of pumping chambers 44 generates the pumping action of pump 20, drawing working fluid from an inlet port 54 at the low pressure side and pressurizing and delivering the working fluid to an outlet port 56 at the high pressure side.

By moving pump control ring 40 about pivot pin 48, the amount of eccentricity, relative to pump rotor 28, can be changed to vary the amount by which the volume of pumping chambers 44 changes from the low pressure side of pump 20 to the high pressure side of pump 20, thus changing the volumetric capacity/displacement of pump 20.

Control ring 40 includes a control structure 60, opposite pivot pin 48 from rotor 32, which is received in a recess 64, formed in pump housing 24.

Control structure 60 divides recess 64 into two opposed control chambers 68 and 72 which can selectively be: connected to a source 76 of pressurized working fluid; a return line 80 to a working fluid sump 84; or isolated to maintain the pressurized working fluid in control chambers 68 and 72.

In the illustrated embodiment, source 76 of pressurized working fluid is a gallery in the mechanical system 88 being supplied with pressurized working fluid from pump outlet 56 but, it will be apparent to those of skill in the art that source 76 can be any direct or indirect connection to outlet 56 of pump 20.

Pump control ring 40 further includes a reaction surface 92 and a biasing spring 96 which acts between pump housing 24 and reaction surface 92 to bias pump control ring 40 to the maximum displacement position. Unlike conventional variable displacement vane pumps, in the illustrated embodiment of pump 20 biasing spring 96 is only intended to provide sufficient biasing force on pump control ring 40 to return pump control ring 40 to the maximum displacement position for start up of pump 20 and regulation of the displacement of pump 20 during operation is achieved with opposed control chambers 68 and 72, as described below. The forces generated on pump control ring 40 by control chamber 68 during operation of pump 20 are significantly larger than the biasing force generated by biasing spring 96. It is contemplated that biasing spring 96 can be omitted, if desired, and pump control ring 40 moved to the maximum displacement position at start up of pump 20 solely by the force created in control chamber 72 by pressurized working fluid, although it is presently preferred that biasing spring 96 be included to improve the start up performance of pump 20.

As mentioned above, opposed control chambers 68 and 72 can selectively be isolated or one of control chambers 68 and 72 can be selectively connected to source 76 while the other of control chambers 68 and 72 is connected to return line 80. The isolation and connection of control chambers 68 and 72 to source 76 and/or return line 80 is achieved by a switching modulator 100. As described further below, switching modulator 100 can be operated in a variety of manners to control the pressure of the working fluid in control chambers 68 and 72.

As should now be apparent to those of skill in the art, by applying pressurized working fluid to control chamber 68 and connecting control chamber 72 to return line 80, pump control ring 40 will be moved towards the minimum displacement position. Similarly, by applying pressurized working fluid to control chamber 72 and connecting control chamber 68 to return line 80, pump control ring 40 will be moved towards the maximum displacement position.

Further, by isolating both of control chambers 68 and 72 from both supply 76 and return line 80, a hydraulic lock can be achieved for a period of time, to maintain pump control ring 40 at any desired position between the maximum and minimum displacement positions. If the hydraulic lock degrades, or is lost, over some period of time while pump 20 is operating, due to leaking, seepage, etc., the hydraulic lock can be re-established by connecting either or both of control chambers 68 and 72, via switching modulator 100, to supply 76 as necessary.

By operating switching modulator 100 accordingly, the volumetric displacement of pump 20 can be adjusted to very closely match the output of pump 20 to the specific requirements for the mechanical system 88 supplied by pump 20 or to any other performance profile which may be desired.

In one embodiment of the present invention, switching modulator 100 is electrically operated and a microcontroller, such as the Engine Control Module (not shown) of an internal combustion engine provides the necessary control signals to switching modulator 100. In such a case, the Engine Control Module (ECM) can monitor the pressure of the working fluid supplied by pump 20 and can compare that pressure to a desired value of pressure for the corresponding engine operating conditions (RPM, coolant temperature, etc.) of the engine.

If the pressure of the working fluid is greater than the required operating pressure, the ECM will operate switching modulator 100 to supply pressurized fluid to control chamber 68 and to connect control chamber 72 to return line 80 such that pump control ring 40 is moved to reduce the volumetric displacement of pump 20. Once the ECM determines that the output pressure has been reduced to be substantially at the required operating pressure, the ECM will control switching modulator 100 configure both of chambers 68 and 76 to establish a hydraulic lock to maintain pump control ring 40 in the desired position.

Conversely, if the pressure of the working fluid is less than the required operating pressure, the ECM will operate switching modulator 100 to supply pressurized fluid to control chamber 72 and to connect control chamber 68 to return line 80 such that pump control ring 40 is moved to increase the volumetric displacement of pump 20. Once the ECM determines that the output pressure has been increased to be substantially at the required operating pressure, the ECM will control switching modulator 100 to again isolate both of control chambers 68 and 72, effectively locking pump control ring 40 in the desired position.

As will be apparent to those of skill in the art, the ECM, or other control system, can compare the actual pressure of working fluid from pump 20 to a determined required pressure at regular intervals and make adjustments to the pressure of the working fluid in control chambers 68 and 72, and hence the position of pump control ring 40, as appropriate. While it is presently preferred that a microcontroller-based control system be used with switching modulator 100, it is contemplated that other control modalities can also be employed if desired, including control systems employing mechanical or hydraulic control mechanisms.

Figure 4:
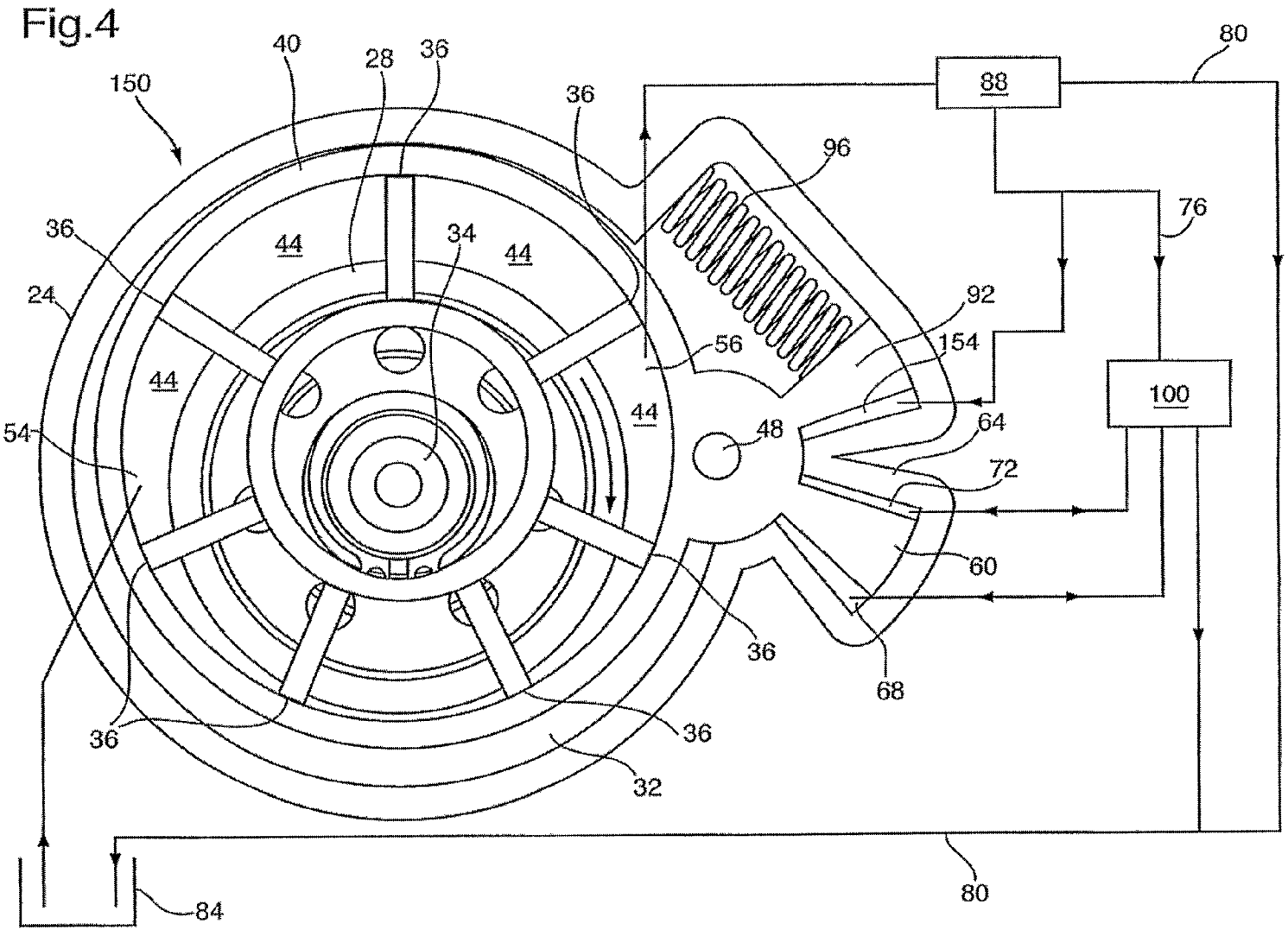
FIG. 4 shows a vane pump whose output pressure is selectable from a continuous range of pressures with a failsafe function in accordance with the present invention.

FIG. 4 shows another embodiment of a pump system and vane pump 150 in accordance with the present invention wherein similar components to those of pump 20 are indicated with like reference numerals. In pump 150, a third control chamber 154 is provided and is connected, either directly or indirectly, to source 76 of pressurized working fluid. As should be apparent to those of skill in the art, third control chamber 154 and biasing spring 96 which, unlike in pump 20 must be present in pump 150, mimic conventional variable displacement pumps which operate with single equilibrium pressure points and thus provide a failsafe function should a failure occur in switching modulator 100, control chambers 68 or 72, etc.

Figure 5:
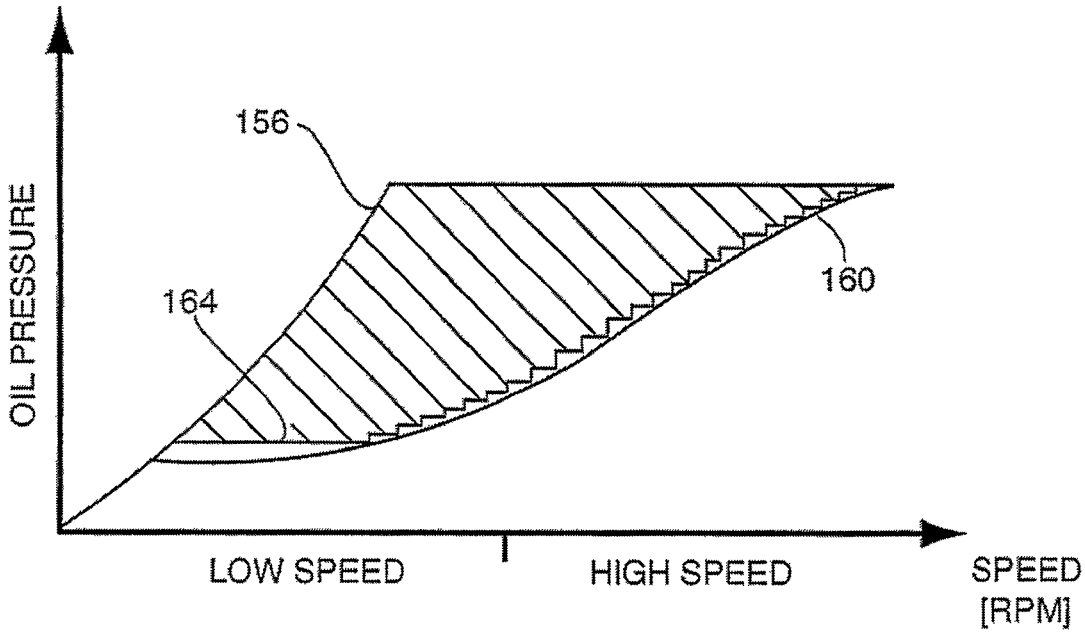
FIG. 5 shows a plot of the oil pressure demand of a mechanical system versus the output of the continuously variable displacement vane pump and system of FIG. 4.

The area of third control chamber 154 over which the pressurized working fluid acts and the spring force of biasing spring 96 are selected to provide a conventional equilibrium operating pressure curve, such as that illustrated in FIG. 5 when the pump is operating in failsafe mode. In this manner, a failure of the continuously variable displacement components, such as switching modulator 100 or chambers 68 or 72, will result in pump 150 operating in failsafe mode wherein it operates as a conventional pump with a single equilibrium operating pressure, thus avoiding potential damage to mechanical system 88.

When switching modulator 100 and control chambers 68 and 72 are functioning normally, pressurized working fluid can be supplied to control chamber 72 to add to the force of biasing spring 96 and counter the force produced in control chamber 154. Alternatively, pressurized working fluid can be supplied to control chamber 68 to add to the force produced in control chamber 154 and to counter the force of biasing spring 96. When pump 150 is operating with pump control ring 40 positioned to achieve a desired displacement, pressurized working fluid can be supplied to each of chambers 68 and 72, or chambers 68 and 72 can be isolated from each of supply 76 and return line 80, to substantially lock pump control ring 40 in that position until it is desired to change the displacement of pump 150.

FIG. 5 shows a plot of the operation of pump 150 versus the working fluid pressure requirements of a mechanical system 88. Curve 156 represents the output of pump 150 in failsafe mode, curve 160 represents the working fluid requirements of mechanical system 88 and curve 164 represents the actual output pressure of pump 150 when operating in non-failsafe mode. The shaded portion between curves 160 and 164 represents the energy "wasted" in the system and can be larger or smaller depending upon the sensitivity of the control system employed to control switching modulator 100 and/or the responsiveness of switching modulator 100. The stippled area between curve 156 and curve 164 represents the energy saved by pump 150 compared to a conventional variable displacement pump with a single equilibrium operating point. As will be apparent to those of skill in the art, if desired, pump 150 can be operated at conditions corresponding to any location within the stippled area, if desired, by altering the control of switching modulator 100.

Figure 6:
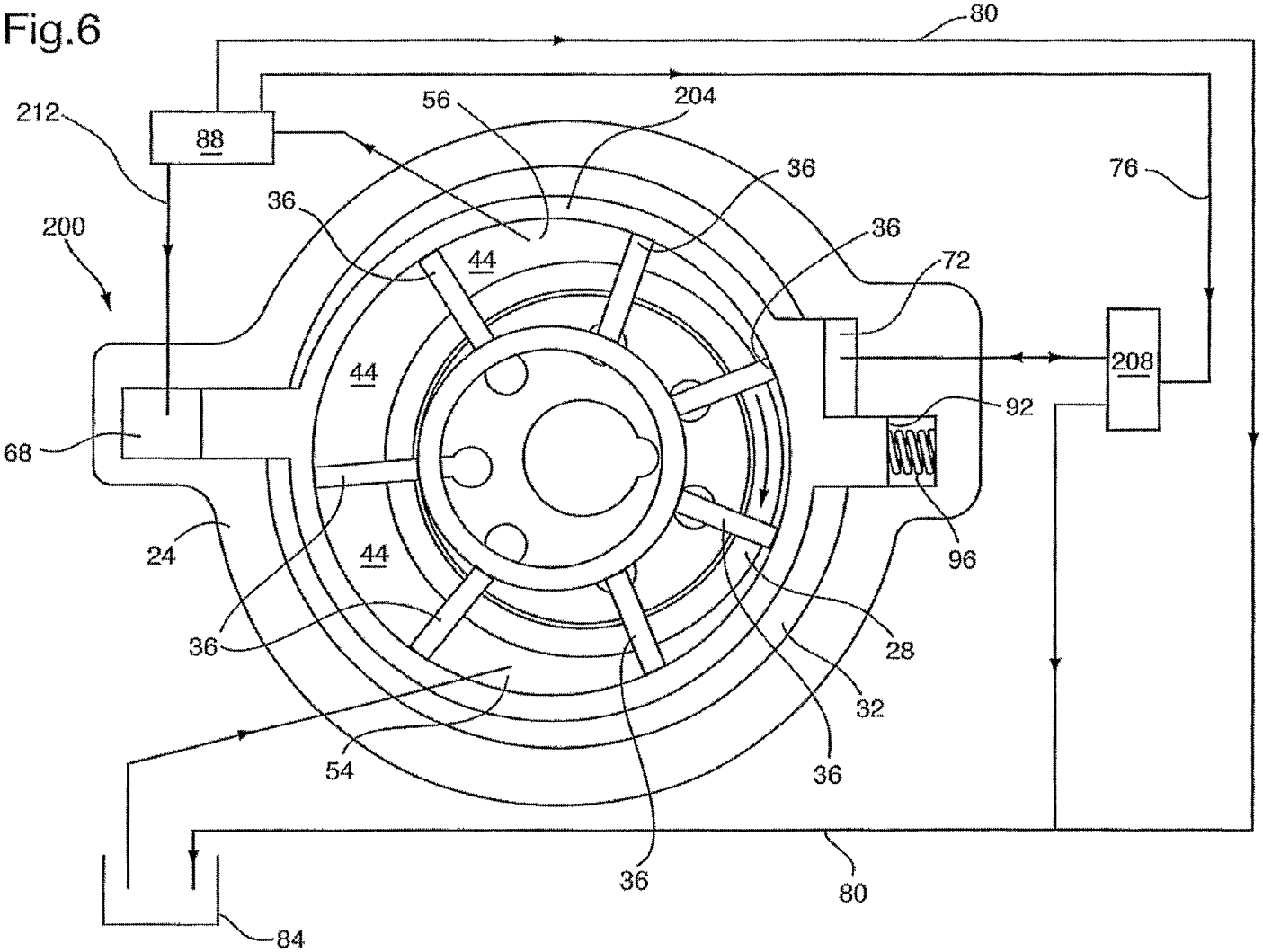
FIG. 6 shows another embodiment of a vane pump whose output pressure is selectable from a continuous range of pressures in accordance with the present invention.

FIG. 6 shows another embodiment of a pump system and vane pump 200 in accordance with the present invention wherein similar components to those of pump 20 are indicated with like reference numerals. In pump 200, pump control ring 204 slides, rather than pivots, to alter the rotor eccentricity and hence the volumetric displacement of pump 200. As was the case with pump 20, biasing spring 96 can be provided to bias control ring 204 to the maximum displacement position for start up of pump 200. In pump 200, control chambers 68 and 72 are located on opposite sides of pump control ring 204 and pressurized working fluid in control chamber 68 will urge pump control ring 204 towards the minimum displacement position while pressurized working fluid in control chamber 72 will urge pump control ring 204 to the maximum displacement position.

While pump 200 can be connected to a similar switching modulator 100 as pump 20, in the illustrated embodiment, pump 200 is controlled via a simplified control valve 208. As shown, control chamber 68 is connected to outlet port 56 of pump 200 and, in the particular illustrated embodiment, this is an indirect connection 212 through a gallery or similar feature of mechanical system 88. Thus, control chamber 68 is continually supplied with pressurized working fluid from pump outlet 56 when pump 200 is operating.

In contrast, control chamber 72 can be selectively supplied with pressurized working fluid from pump outlet 56 or can be isolated to maintain the pressure on chamber 72 or can be connected to return line 80 to relieve the pressure in chamber 72.

As will now be apparent, the volumetric displacement of pump 200, and hence the pressure of the working fluid it supplies to mechanical system 88, can be altered as required during operation of pump 200 by selectively applying and relieving pressurized working fluid in control chamber 72 via control valve 208, or can be maintained, during unchanging operating conditions, by isolated chamber 72 from supply 76 and return line 80.

As the supply of pressurized working fluid is always applied to control chamber 68, it is preferred that the pressurized working fluid in control chamber 72 act over a larger area than the area of control chamber 68 to ensure that sufficient force can be developed in control chamber 72 to move pump control ring 204 against the force created in control chamber 68, especially if biasing spring 96 is omitted.

While pump 200 has been shown with simplified control valve 208 and with control chamber 68 continually supplied with pressurized working fluid, it should be apparent to those of skill in the art that pumps in accordance with the present invention which employ sliding pump control rings can also be controlled with switching modulator 100 or the like and, in such a case, each of control chambers 68 and 72 can be selectively supplied, isolated or relieved of pressurized working fluid.

Further, while pump 20 has been shown with switching modulator 100 and with each of control chambers 68 and 72 selectively supplied, isolated or relieved of pressurized working fluid, it should be apparent to those of skill in the art that pumps in accordance with the present invention which employ pivoting pump control rings can also be controlled with a simplified control valve 208 and switching modulator 100 or the like and, in such a case, control chamber 68 can be continually supplied with pressurized working fluid.

Figure 7:
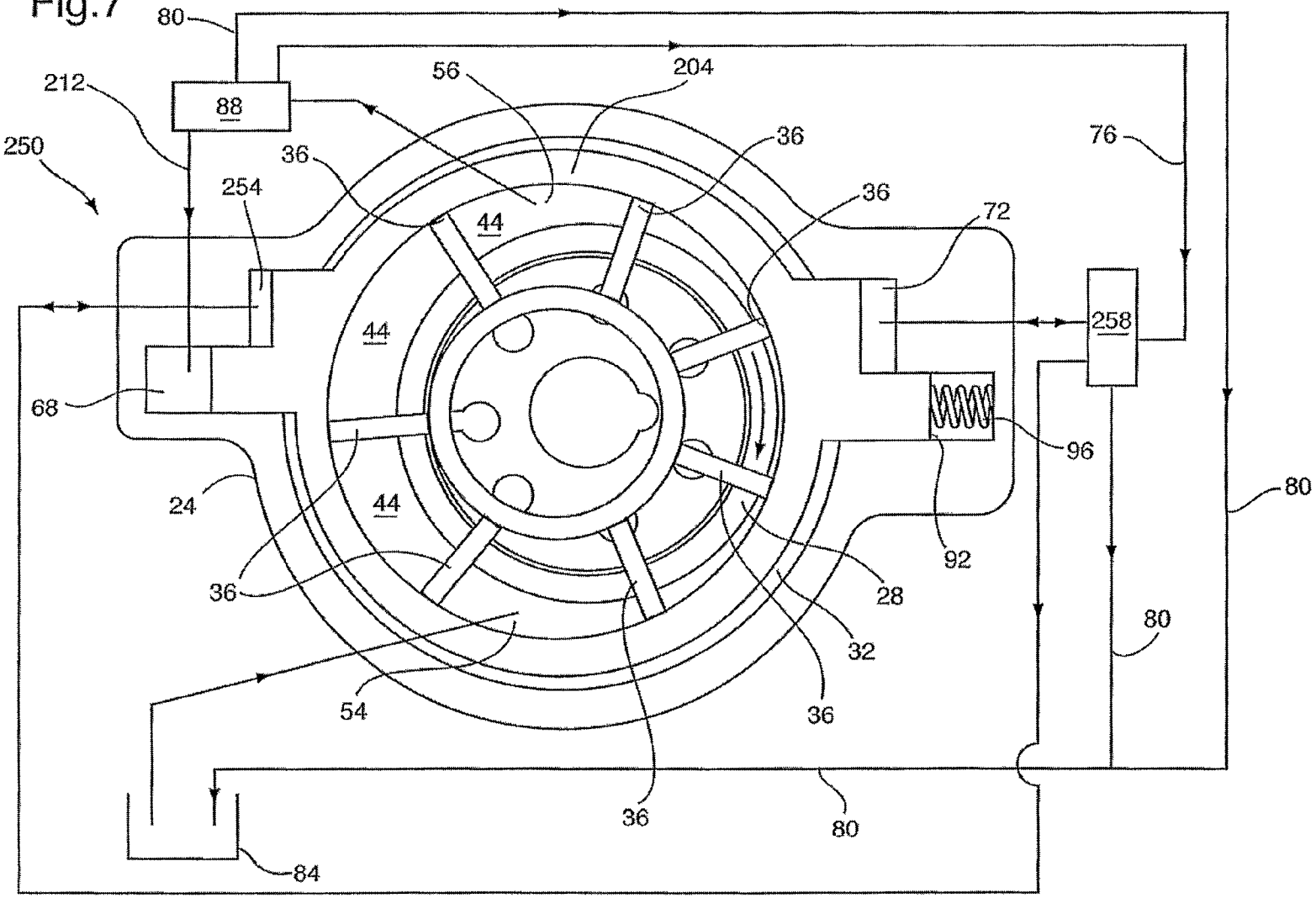
FIG. 7 shows another embodiment of a vane pump whose output pressure is selectable from a continuous range of pressures in accordance with the present invention.

FIG. 7 shows another embodiment of a pump system and vane pump 250 in accordance with the present invention wherein similar components to those of pump 200 are indicated with like reference numerals. In pump 250, a third control chamber 254 is provided and, like control chamber 72, control chamber 254 can selectively be connected to supply 76, return line 80 or isolated from both to either supply third chamber 254 with pressurized working fluid, relieve chamber 254 of pressurized working fluid or isolate chamber 254 from both supply 76 or return line 80.

In operation, chamber 68 and biasing spring 96 provide a failsafe operation for pump 254 similar to that discussed above with respect to pump 150. In non-failsafe operating conditions, chambers 72 and 254 operate, under the control of switching modulator 258, to alter the displacement of pump 250 as desired and as described previously above.

The above-described embodiments of the invention are intended to be examples of the present invention and alterations and modifications may be effected thereto, by those of skill in the art, without departing from the scope of the invention which is defined solely by the claims appended hereto.

We claim:

1. A vane pump with continuously variable output pressure, comprising:

a variable displacement vane pump having a pump control ring which is moveable to alter the displacement of the pump and spring biased to a position of maximum displacement;

a first control chamber operable to create a force on the pump control ring to urge the pump control ring towards a position of minimum displacement, the force resulting from pressurized working fluid in the first control chamber;

a second control chamber operable to create a force on the pump control ring to urge the pump control ring towards the position of maximum displacement, the force resulting from pressurized working fluid in the second control chamber;

a control means operable to vary supply of pressurized working fluid to at least one of the first and second control chambers to vary the displacement of the control ring during operation of the pump to achieve an output pressure selected from a continuously variable range of output pressures from the pump which are independent from an operating speed of the pump.

2. The vane pump of claim 1 wherein the control means comprises a switching modulator operable to selectively supply, isolate or relieve pressurized working fluid from the first and second control chambers.

3. The vane pump of claim 1 wherein the pump control ring pivots between the maximum displacement position and the minimum displacement position.

4. The vane pump of claim 1 wherein the pump control ring slides between the maximum displacement position and the minimum displacement position.

5. The vane pump of claim 1 further comprising the biasing spring to urge the pump control ring towards the maximum displacement position.

6. The vane pump of claim 1 wherein the first control chamber is continuously supplied with pressurized working fluid when the pump is operating and wherein the control means comprises a valve to selectively supply or relieve pressurized working fluid to the second control chamber.

7. The vane pump of claim 1 further comprising a third control chamber positioned to urge the pump control ring against the force of the biasing spring, the third control chamber and the biasing spring providing a failsafe function should a failure occur in any of the control means, first control chamber or second control chamber.

8. A vane pump to supply pressurized working fluid to a mechanical system, the output pressure being selected from a continuously variable range of output pressures from the pump which are independent of the operating speed of the pump, comprising:

a variable displacement vane pump having a pump control ring which is moveable to alter the displacement of the pump;

a first control chamber operable to receive working fluid pressurized by the pump to create a force to urge the pump control ring towards a position of minimum displacement;

a biasing spring to urge the pump control ring towards a maximum displacement position;

a second control chamber operable to receive working fluid pressurized by the pump to create a force to urge the pump control ring towards the position of maximum displacement;

a control means operable to vary the supply of pressurized working fluid to at least one of the first and second control chambers to vary the displacement of the pump during operation of the pump to achieve an output pressure selected from a continuously variable range of output pressures from the pump which are independent from an operating speed of the pump; and a third control chamber operable to continuously receive working fluid pressurized by the operation of the pump to create a force on the pump control ring to oppose the force of the biasing spring, the third control chamber and the biasing spring providing a failsafe function should a failure occur in the control means, the first control chamber or the second control chamber.

9. The vane pump of claim 8 wherein the control means is responsive to a predefined set of parameters to alter the displacement of the pump to correspond to the operating conditions of the mechanical system supplied with pressurized fluid from the pump.

10. The vane pump of claim 9 wherein the set of parameters comprises a set of operating speed and corresponding working fluid pressure requirements for the mechanical system.

11. The vane pump of claim 10 wherein the mechanical system is an internal combustion engine and the working fluid comprises lubricating oil.

12. The vane pump of claim 8 wherein the control means comprises a switching modulator operable to selectively supply or relieve pressurized working fluid from the first and second control chambers.

13. The vane pump of claim 12 wherein the switching modulator is controlled by a microcontroller.

14. The vane pump of claim 8 wherein the control means comprises a switching modulator operable to selectively supply, isolate or relieve pressurized working fluid from the first and second control chambers.

15. The vane pump of claim 8 wherein the pump control ring pivots between the maximum displacement position and the minimum displacement position.

16. The vane pump of claim 8 wherein the pump control ring slides between the maximum displacement position and the minimum displacement position.

* * * * *

UNITED STATES PATENT AND TRADEMARK OFFICE

CERTIFICATE OF CORRECTION

PATENT NO. : 8,047,822 B2
APPLICATION NO. : 12/299538
DATED : November 1, 2011
INVENTOR(S) : David R. Shulver et al.

It is certified that error appears in the above-identified patent and that said Letters Patent is hereby corrected as shown below:

On title page, item 57 Abstract,
replace “hat”
with “that.”

On title page, item 57 Abstract,
replace “ump”
with “pump.”

On title page, item 57 Abstract,
replace “ump”
with “pump.”

Signed and Sealed this
Thirty-first Day of January, 2012

David J. Kappos

David J. Kappos
*Director of the United States Patent and Trademark Office*